US010764687B2

(12) United States Patent
Zhou et al.

(10) Patent No.: US 10,764,687 B2
(45) Date of Patent: Sep. 1, 2020

(54) SOUND GENERATOR

(71) Applicant: AAC Technologies Pte. Ltd., Singapore (SG)

(72) Inventors: Jiasheng Zhou, Shenzhen (CN); Long Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/524,183

(22) Filed: Jul. 29, 2019

(65) Prior Publication Data

US 2020/0045440 A1 Feb. 6, 2020

(30) Foreign Application Priority Data

Aug. 1, 2018 (CN) ..... 2018 2 1237367 U

(51) Int. Cl.

| | |
|---|---|
| ***H04R 9/02*** | (2006.01) |
| ***H04R 1/28*** | (2006.01) |
| ***H04R 9/06*** | (2006.01) |
| ***H04R 1/02*** | (2006.01) |

(52) U.S. Cl.

CPC ..... *H04R 9/025* (2013.01); *H04R 1/023* (2013.01); *H04R 1/2811* (2013.01); *H04R 9/06* (2013.01); *H04R 2209/024* (2013.01); *H04R 2499/11* (2013.01)

(58) Field of Classification Search

CPC ..... H04R 9/025; H04R 1/2811; H04R 1/023; H04R 9/06; H04R 2209/024; H04R 2499/11

See application file for complete search history.

(56) References Cited

U.S. PATENT DOCUMENTS

| | | | | |
|---|---|---|---|---|
| 8,300,876 | B2 * | 10/2012 | Xu | H04R 1/06 381/150 |
| 8,379,904 | B2 * | 2/2013 | Liu | H04R 9/063 181/181 |
| 8,995,704 | B2 * | 3/2015 | Huang | H04R 9/043 181/171 |
| 2004/0218779 | A1 * | 11/2004 | Fukuyama | H04R 1/06 381/409 |
| 2007/0164616 | A1 * | 7/2007 | Kuwabara | B06B 1/045 310/15 |
| 2007/0187172 | A1 * | 8/2007 | Kaneda | B06B 1/045 181/181 |

(Continued)

*Primary Examiner* — Oyesola C Ojo
(74) *Attorney, Agent, or Firm* — W&G Law Group LLP

(57) ABSTRACT

The present invention provides a sound generator, includes a frame with an accommodating space, a magnetic circuit system and a vibration system. The magnetic yoke includes a bottom wall, a side wall and a supporting plate bending and extending from the side wall. The frame includes an upper surface close to the diaphragm and a lower surface provided with a fixing post. The spring includes an inner edge close to the accommodating space and an outer edge opposite to the inner edge and far away from the accommodation space. The fixing post is provided between the inner edge of the spring and the side wall. Compared to the relate art, the spring of the present invention can make more effective use of space, ensure the spring size, thus reducing the low-frequency response of the sound generator to further improve the acoustic performance.

8 Claims, 2 Drawing Sheets

(56) References Cited

U.S. PATENT DOCUMENTS

| | | | | |
|---|---|---|---|---|
| 2011/0311093 | A1* | 12/2011 | He | H04R 9/06 381/410 |
| 2012/0106775 | A1* | 5/2012 | Shao | H04R 9/043 381/412 |
| 2012/0155693 | A1* | 6/2012 | Wei | H04R 9/06 381/386 |
| 2017/0085992 | A1* | 3/2017 | Vitt | H04R 1/06 |

* cited by examiner

SOUND GENERATOR

FIELD OF THE PRESENT DISCLOSURE

The embodiments of the invention relate to the electroacoustic components, in particular to a sound generator used in a portable device.

DESCRIPTION OF RELATED ART

With the arrival of mobile internet era, the number of intelligent mobile devices is on the increase. While among so many mobile devices, mobile phone is undoubtedly the most common and portable mobile device. Currently, mobile phone has a great variety of functions including but not limited to high-quality music function, and a loudspeaker in the mobile phone is one of the necessary conditions for achieving such high-quality music function.

A sound generator usually comprises a frame, a vibration system accommodated in the frame and a magnetic circuit system driving the vibration system to vibrate. In related art, to expand the audio and realize electrical connection, a spring connected with the magnetic circuit system and the frame is usually provided; the spring of the prior art is usually provided inside the inner space of the frame and thus limited in size, causing great loss in performance, allowing no further decrease in low-frequency response $F_0$ of products.

Therefore, it is necessary to provide an improved sound generator to solve the problem above.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to exemplary embodiment. To make the technical problems to be solved, technical solutions and beneficial effects of the present disclosure more apparent, the present disclosure is described in further detail together with the figures and the embodiment. It should be understood the specific embodiment described hereby are only to explain the disclosure, not intended to limit the disclosure.

Figure 1:
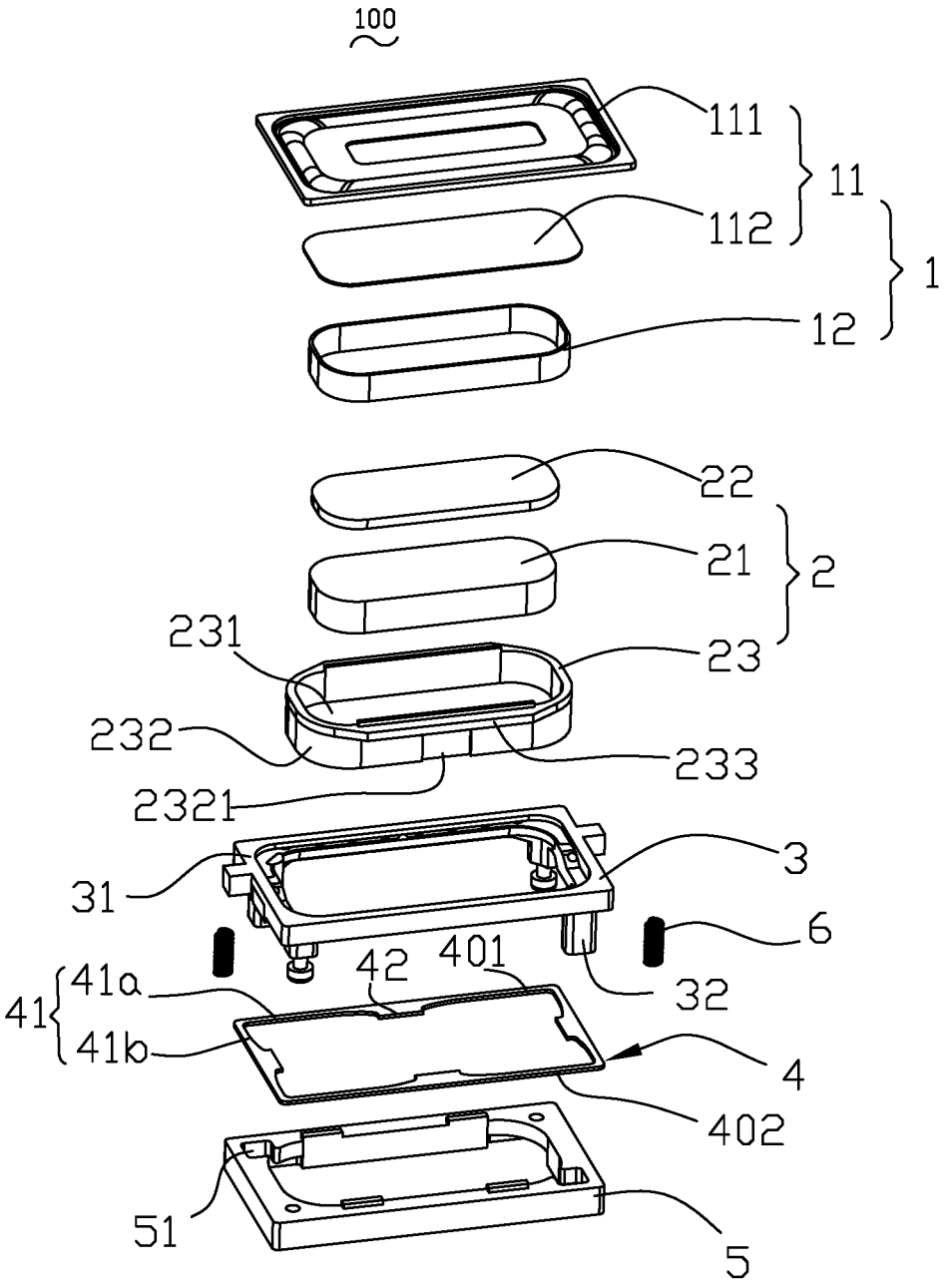
FIG. 1 is an exploded view of a sound generator in accordance with an exemplary embodiment of the invention.
Figure 2:
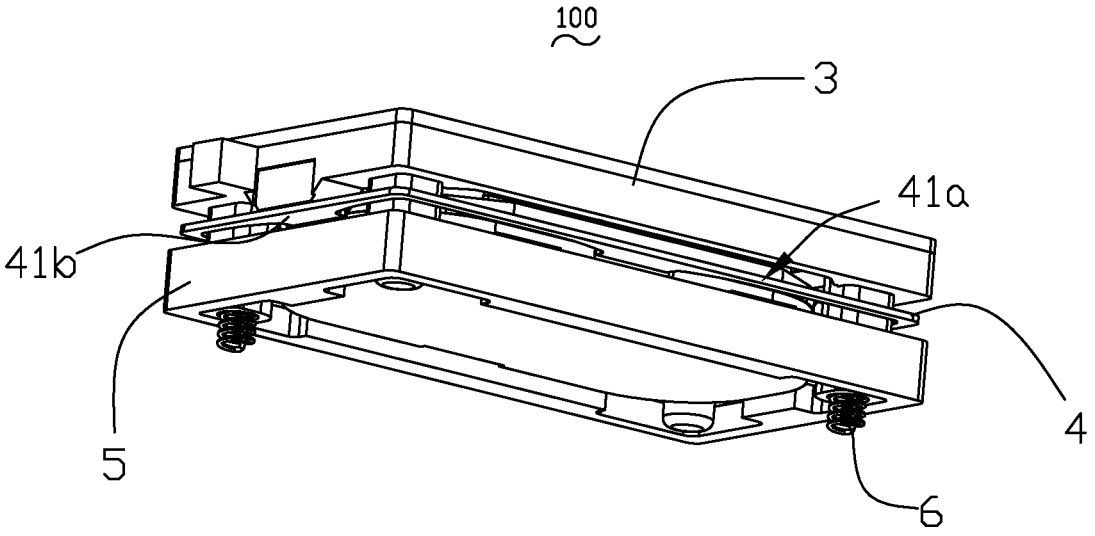
FIG. 2 an assembled view of the sound generator in FIG. 1.

As shown in FIG. 1 and FIG. 2, the present invention provides a sound generator 100, comprising a vibration system 1, a magnetic circuit system 2, a frame 3 accommodating and fixing the vibration system 1 and the magnetic circuit system 2, a spring 4 connecting the magnetic circuit system 2 and the frame 3, and a lower cover 5 assembled together with the frame 3 to complete the packaging.

The frame 3 has an inner accommodation space, and comprises an upper surface 31, a lower surface opposite to the upper surface 31, and a fixing post 32 protruding from the lower surface in a direction far away from the upper surface 31.

The vibration system 1 comprises a diaphragm 11 and a voice coil 12 for driving the diaphragm 11 to vibrate to further generate sound. The voice coil 12 is formed by wrapping conductive wires. The diaphragm 11 comprises a dome 112 and a suspension 111 surrounding the dome 112. In this embodiment, the dome 112 is attached to a top of the suspension 111. An outer periphery of the suspension 111 is fixed on the upper surface 31 of the frame 3. A magnetic gap is formed by the magnetic circuit system 2, and the voice coil 12 is partially inserted into the magnetic gap. The voice coil 12 is used to interact with the magnetic fluxes produced in the magnetic gap while electrified, for driving the diaphragm 12 to vibrate along a vibration direction.

The magnetic circuit system 2 comprises a magnet 21, a pole plate 22 attached to the magnet 21 and a magnetic yoke 23 accommodating the magnet 21 and the pole plate 22. The pole plate 22 is made of magnetic conductive material for magnetic induction, magnetic field convergence to improve the magnetic inductive capacity of the products. Specifically, the magnetic yoke 23 comprises a bottom wall 231 opposite to the diaphragm 11, a side wall 232 extending from an edge of the bottom wall 231 in a direction towards the diaphragm 11 and a support plate 233 bending and extending from the side of the side wall 232 far away from the bottom wall 231. The bottom wall 231 of the magnetic yoke 23 is a track-type structure, the magnet 21 is a track-type magnet, the pole plate 22 has a same structure as that of the magnet 21, with the magnetic gap formed between the magnet 21 and the wall 232 of the magnetic yoke 23. The voice coil 12 is inserted into the magnetic gap between the magnet 21 and the side wall 232.

The spring 4 is provided at a lower surface side of the frame 3. Specifically, the spring 4 comprises a main body 41 provided at the lower surface and a support part 42 protruding and extending from the main body 41 in the direction towards the accommodation space, the support plate 233 of the magnetic yoke 23 is lapped onto the support part 42, thus realizing supporting and fixing of the magnetic circuit system 2. Preferably, a spacing slot 2321 corresponding to the support part 42 is provided on the side wall 232 of the magnetic yoke 23. The main body 41 includes a first arm 41*a* located on two opposite sides of the magnetic yoke and a second arm 41*b* connected with the first arm 41*a*, the first arm 41*a* and the second arm 41*b* enclosing a circle around the magnetic yoke 23, the second arm 41*b* is fixed to the lower surface and the support part 42 extends from the inner edge 401 of the first arm 41*a* to the magnetic yoke 23, with the first arm 41*a* spaced apart from the lower surface. The support part 42 is inserted into the spacing slot 2321, thus realizing sufficient positioning of the product to avoid slide effectively and thus affecting reliability of the product. Specifically in this embodiment, a total of four support parts 42 are provided on the periphery of the magnetic yoke 23 respectively. Correspondingly, four spacing slots 2321 are formed.

Figure 3:
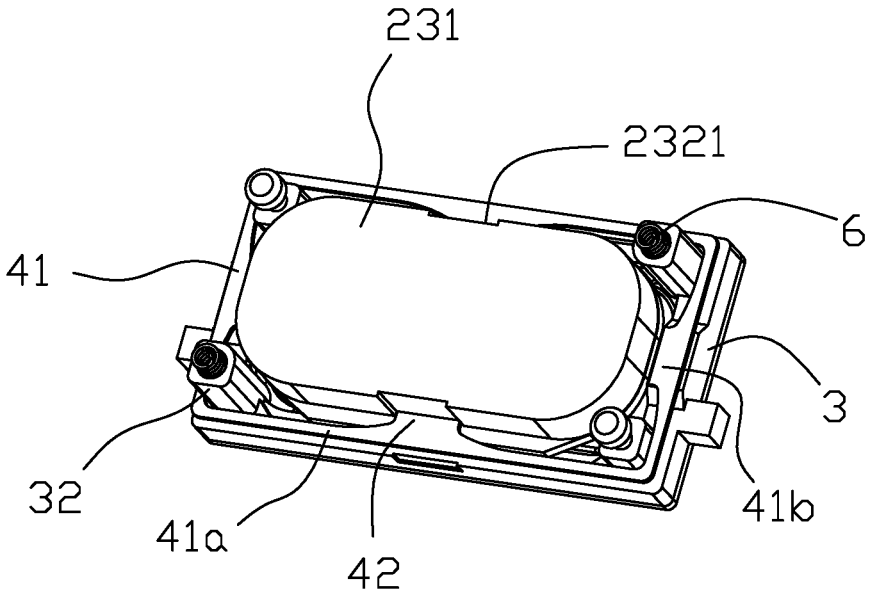
FIG. 3 is an assembled view of the sound generator, but some parts thereof being removed.

As shown in FIG. 3, the spring 4 is an annular structure, in a direction parallel to the diaphragm. The spring 4 comprises an inner edge 401 close to the accommodation space and an outer edge 402 opposite to the inner edge 401 and far away from the accommodation space. The fixing post 32 is provided between the inner edge 401 of the spring 4 and the side wall 232. Specifically in this embodiment, a total of four fixing posts 32 are provided on four corners of the frame 3 respectively for supporting and fixing. Correspondingly, the spring 4 is a four-corner shaped structure including four adapting structures on its inner edge, such adapting structures are provided as sleeves on the peripheral edge of the fixing post 32. Therefore, it can achieve yielding of the fixing post and make full use of the external space of the frame, so as to expand the elastic arm of the spring to the maximum degree, thus reducing the low-frequency response of the sound generator to improve the acoustic performance.

Further, an electrical connector 6 is provided on the fixing post 32 for electrically connecting with an external circuit. The electrical connector 6 is a conductive spring or conductive pad. Specifically in this embodiment, the electrical connector 6 is a conductive spring, and four fixing posts 32 are provided, two of which are provided with conductive pads and the other two of which only have the function of supporting and fixing. The electrical connector 6 can be injection molded into the two of the fixing posts 32 by injection molding, and can also be inserted into the fixing post 32 in a separable structure.

The lower cover 5 is provided with a positioning hole 51 for accommodating the fixing post. Specifically in this embodiment, two positioning holes 51 are provided for accommodating the fixing post 32 provided with the electrical connector. Therefore, it can facilitate the connection with the external circuit.

The sound generator of the present invention comprises a frame with an accommodating space, a magnetic circuit system and a vibration system accommodated in the frame and a spring connecting the magnetic circuit system and the frame. The vibration system comprises a diaphragm and a voice coil for driving the diaphragm to drive. The magnetic circuit system comprises a magnetic yoke and a magnet carried by the magnetic yoke. The magnetic yoke comprises a bottom wall opposite to the diaphragm, a side wall extending from the edge of the bottom wall towards the direction of the diaphragm and a supporting plate bending and extending from the side wall towards the direction far away from the magnet. The frame comprises an upper surface close to the diaphragm and a lower surface far away from the diaphragm, the lower surface provided with a fixing post protruding towards the direction far away from the upper surface. The spring comprises a main body provided at the lower surface and a supporting part protruding and extending from the main body towards the accommodating space. The supporting plate of the magnetic yoke is lapped on the supporting part. The spring comprises an inner edge close to the accommodating space and an outer edge opposite to the inner edge and far away from the accommodation space. The fixing post is provided between the inner edge of the spring and the side wall. Compared to the relate art, the spring of the present invention can make more effective use of space, ensure the spring size, thus reducing the low-frequency response of the sound generator to further improve the acoustic performance.

It is to be understood, however, that even though numerous characteristics and advantages of the present exemplary embodiment have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A sound generator, comprising:

a frame with an accommodating space;

a vibration system accommodated in the frame, including a diaphragm and a voice coil for driving the diaphragm to drive;

a magnetic circuit system including a magnetic yoke having a bottom wall opposite to the diaphragm, a side wall extending from an edge of the bottom wall towards the diaphragm and a supporting plate bending and extending from the side wall along a direction away from the magnet, and a magnet carried by the magnetic yoke;

a spring connecting the magnetic circuit system and the frame; wherein the frame comprises an upper surface close to the diaphragm and a lower surface away from the diaphragm, the lower surface provided with a fixing post protruding along a direction away from the upper surface;

the spring comprises a main body provided at the lower surface and a support part protruding and extending from the main body towards the magnetic yoke for engaging with the magnetic yoke; and wherein the spring further comprises an inner edge close to the accommodating space and an outer edge opposite to the inner edge and away from the accommodation space, the fixing post locates between the inner edge of the spring and the side wall;

the main body comprises a first arm located on two opposite sides of the magnetic yoke and a second arm connected with the first arm, the first arm and the second arm enclosing a circle around the magnetic yoke, the second arm is fixed to the lower surface and the support part extends from the inner edge of the first arm to the magnetic yoke, with the first arm spaced apart from the lower surface.

2. The sound generator as described in claim 1 further including an electrical connector disposed on the fixing post for being electrically connecting with an external circuit, wherein one end of the electrical connector is connected with the voice coil, another end extends to outside of the accommodating space.

3. The sound generator as described in claim 2, wherein the electrical connector is a conductive spring or a conductive pad.

4. The sound generator as described in claim 1 further comprising a lower cover matched with the frame, wherein the lower cover includes a positioning hole for accommodating the fixing post.

5. The sound generator as described in claim 4, wherein the spring is sandwiched and fixed between the frame and the lower cover; and the main body is completely spaced apart from the lower cover.

6. The sound generator as described in claim 1 including four fixing posts provided on four corners of the spring respectively.

7. The sound generator as described in claim 1, wherein a spacing slot corresponding to the support part is provided on the sidewall of the magnetic yoke, and the support part is inserted in the spacing slot.

8. The sound generator as described in claim 1, wherein a bottom wall of the magnetic yoke is a rounded rectangle, the magnet in the magnetic yoke has a shape matched with the bottom wall, and the magnetic gap accommodating the voice coil is formed between the magnet and the side wall of the magnetic yoke, with a pole plate attached to the surface of the magnet away from the bottom wall.

* * * * *